United States Patent [19]

Lisles

[11] 4,151,852

[45] May 1, 1979

[54] CLEANING OF OVEN DOORS

[75] Inventor: Brian R. Lisles, Surbiton, England

[73] Assignee: British Steel Corporation, London, England

[21] Appl. No.: 862,199

[22] Filed: Dec. 19, 1977

[51] Int. Cl.[2] ..... B08B 3/02; C10B 43/08

[52] U.S. Cl. ..... 134/168 R; 134/181; 15/93 A

[58] Field of Search ..... 134/166 R, 167 R, 168 R, 134/172, 180–181; 15/93 A

[56] References Cited

U.S. PATENT DOCUMENTS

| | | | |
|---|---|---|---|
| 1,715,100 | 5/1929 | Septant | 134/181 |
| 2,691,380 | 10/1954 | Bartos | 134/167 R X |
| 3,837,011 | 9/1974 | McTighe et al. | 134/167 R X |
| 3,847,753 | 11/1974 | Baird et al. | 134/172 X |
| 3,892,250 | 7/1975 | Miko | 134/168 R |
| 3,926,667 | 12/1975 | Gibellina | 134/167 R |

FOREIGN PATENT DOCUMENTS

| | | | |
|---|---|---|---|
| 26377 | 1/1954 | Finland | 134/168 R |
| 700302 | 12/1940 | Fed. Rep. of Germany | 134/167 R |
| 1261768 | 2/1968 | Fed. Rep. of Germany | 134/166 R |

*Primary Examiner*—Robert L. Bleutge
*Attorney, Agent, or Firm*—Bacon & Thomas

[57] ABSTRACT

A machine for cleaning the sealing surfaces of coke oven doors or door jambs. A high pressure water jet is emitted from a nozzle which is driven on a closed path adjacent the sealing surface, the nozzle block being rotatably mounted with respect to its carriage so that the nozzle block can be driven continuously in the same direction without twisting the water supply hose.

12 Claims, 4 Drawing Figures

CLEANING OF OVEN DOORS

This invention relates to improvements in the cleaning of oven doors or door jambs. It is particularly concerned with coke ovens but may be advantageously applied to other kinds of ovens where sealing is a problem because of the build-up of contaminants on the door or the door jamb.

The conventional technique for automatic cleaning of the sealing surfaces of coke oven doors or door jambs uses spaced scraper blades which are reciprocated or circulated by a cleaning machine so that the blades act to remove the undesirable carbonaceous deposits from the sealing surfaces. With more stringent requirements for the control of noxious emissions from coke oven doors, it has been found that this conventional technique is not always sufficient to remove hard deposits from the sealing surfaces. Neither is the cleaning sufficient to prevent flames from badly sealed doors damaging the oven structure.

It is an object of the invention to provide a more efficaceous cleaning mechanism.

According to one aspect of the present invention a machine is provided for cleaning the sealing surfaces of an oven door or door jamb, said machine including a frame, a drivable conveying means held in said frame and having a carrier mounted thereto, the arrangement being such that the carrier is drivable continuously on a closed path adjacent and parallel to the sealing surfaces of the door or jamb, and water nozzle means rotatably mounted in or on the carrier such that as the carrier moves on its closed path the nozzle means is adapted to direct a jet of water towards the sealing surfaces of the door or jamb.

The nozzle means is preferably adapted to direct at least two flat fan-shaped jets towards the sealing surfaces of the door or jamb. The nozzle means may be further adapted so that the fan-shaped jets have a common axis and are equi-angularly spaced.

The conveying means may include a chain mechanism. The chain mechanism may include two parallel chains to which the carrier is attached. The frame may include guide means for guiding the carrier around its closed path. The conveying means may be driven by a variable speed motor such as an hydraulically operable motor.

The machine may incorporate a high pressure water pump and hose arrangement which supplies water at between 1000 and 10,000 psi to the water nozzle means.

The invention is particularly suitable for the cleaning of the vertical doors of coke oven or the jambs thereof.

An embodiment of the invention will now be described, by way of example only, with reference to the accompanying drawings in which.

An approximately rectangular frame 10 made from steel sections has trunnion mountings 11 which enable the frame 10 to be supported by a coke oven door extractor or other similar mobile machine. The cleaner could alternatively be fixed to the oven structure itself. As well as being supported on the machine (not shown) the frame is braced so that it lies in a vertical plane perpendicular to the face of the ovens with which the cleaner is associated.

Figure 2:
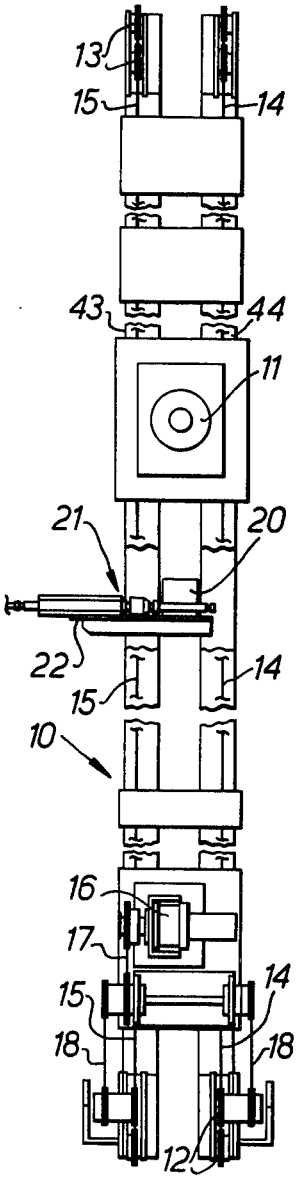
FIG. 2 is a side elevation of the cleaner of FIG. 1.
Figure 3:
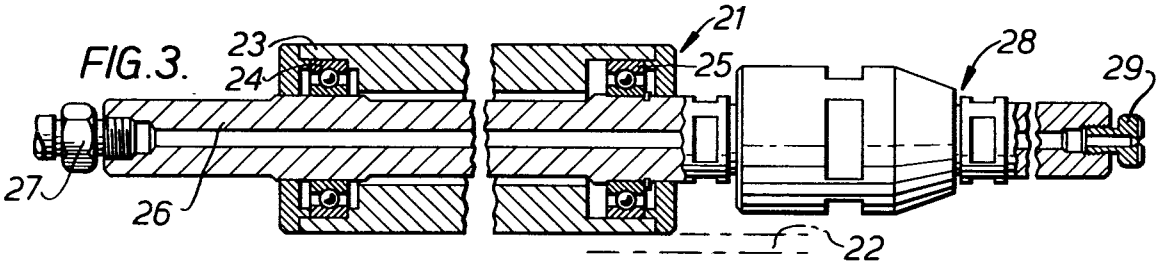
FIG. 3 shows in cross-section a detail of the cleaner of FIGS. 1 and 2.
Figure 4:
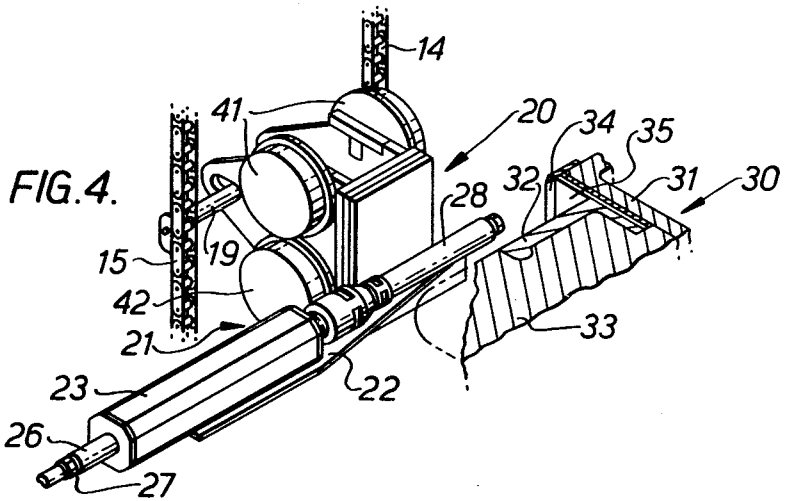
FIG. 4 is an isometric view of part of the cleaner shown in position adjacent a door to be cleaned.

The frame 10 carries two sets of sprockets, 12 and 13 respectively, each of which supports a continuous chain, shown as 14 and 15 respectively in FIGS. 2 and 4. Both chains 14 and 15 are simultaneously driven from a variable speed hydraulic motor 16 (i.e. a motor whose speed can be varied over a given range) through transmission chains 17 and 18 which in turn driven one each of the sprockets 12 and 13.

A bar 19 (see FIG. 4) is secured at its ends to the chains 14 and 15 such that it extends perpendicularly to both chains. A carriage 20 is mounted to the bar 19, said carriage 20 extending away from the plane containing the two chains 14 and 15. The carriage 20 forms a carrier for a water jet nozzle assembly 21 which is attached to a plate 22 mounted on the carriage 20.

The carriage 20 is guided in its movement with the chains 14 and 15 by two pairs of wheels 41 and 42 respectively, which are located in channel shaped members in the frame 10 of the cleaner. The channel members have been omitted from FIG. 4 for the sake of clarity, but are formed by flanged frame members 43 and 44 seen in FIG. 2.

The water jet nozzle assembly 21 comprises a body portion 23 which is attached to plate 22. Within the body portion 23 are mounted two bearings 24 and 25 which support a hollow stem member 26 extending from both ends of the body portion 23. A hose connector 27 is screwed into one end of the stem member 26, and a nozzle holder 28 is fitted to the other end of the stem member 26. The stem member 26 together with its hose connector 27 and nozzle holder 28 are thus rotatable in the body portion 23 of the assembly 21.

A nozzle 29 is screwed into the free end of the nozzle holder 28. The nozzle 21 has a centrally located orifice with two flow controlling channels cut into the face of the nozzle, the channels being at right angles to one another. This form of nozzle provides two mutually perpendicular flat fan-shaped jets when water under high pressure is forced through the nozzle orifice. For further details of the nozzle 21, see our co-pending British application No. 52624/76.

Figure 1:
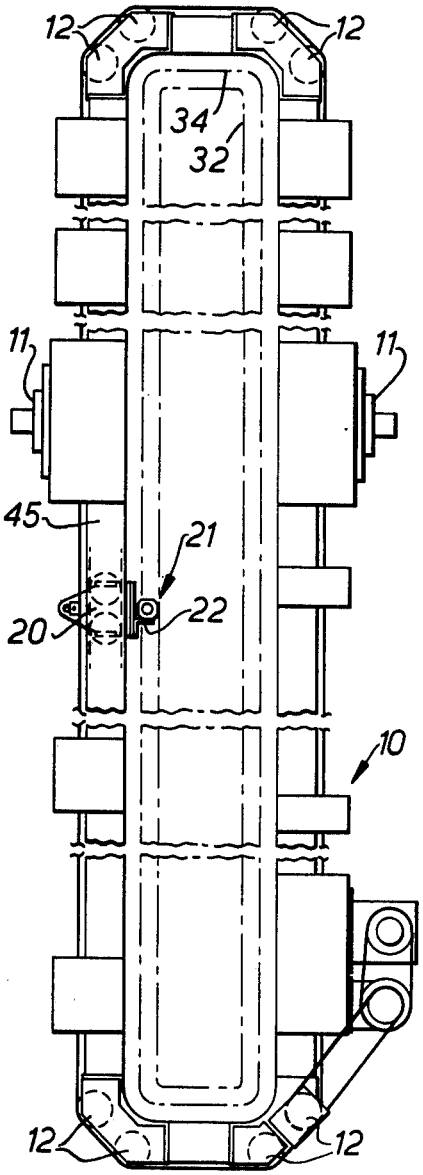
FIG. 1 is a front elevation of a coke oven door or door jamb cleaner.

In FIG. 4 the carriage 20 and assembly 21 is shown in position adjacent a coke oven door 30. The door 30 is formed from a channel-shaped main door casting 31 with two angle sections 32 bolted to the outside of the base of the channel—only one of the angle sections 32 can be seen in FIG. 4. A wedge 33 of refractory material extends outwardly between the two angle sections 32 to protect the steel or iron portion of the door from the oven heat. A knife-edged strip 34 is attached to the outer edge of the main door casting which is use acts with the sealing surfaces of the door jamb to seal the oven door against the emission of fume and gas. Both the knife-edged strip 34 and the adjacent surface 35 as well as the outside surface of the angle section 32, tend in use to become coated with tarry deposits, and it is these surfaces which need cleaning. The knife-edged strip 34 and the edge of the angle section are shown in chain-dotted line in FIG. 1.

The plate 22 is adjustable relative to the carriage 20 to permit the nozzle 29 to be positioned at different distances from the knife edged strip 34 and surface 35. The jet nozzle assembly 21 is adjustable on plate 22 to enable the nozzle 29 to be moved towards or away from the angle section 35 on the door. The nozzle 29 itself is arranged in use so that the line of intersection of one of the flat fan-shaped jets with the surface 35 is perpendicular to the direction of travel of the nozzle 29.

The hydraulic motor 16 on frame 10 is connected with a suitable high pressure water supply. The stem member 26 is supplied through connector 27 and suitable pressure hose with a high pressure water pump (not shown). In use, the carriage 20 is driven continuously around the frame adjacent and parallel to the door to be cleaned by the hydraulic motor 16 and the various chains 17, 18 and 14, 15. The nozzle 29 emits water under high pressure between 1000 and 10,000 psi (in this example around 8000 psi) in two flat fans, one of these having a line of contact with surface 35 which is perpendicular to the direction of travel of the nozzle 29. This first flat fan embraces the knife-edged strip 34 on the door, the surface 35 and as much of the outside of the angle section 32 as need to be cleaned. As the nozzle moves the first flat fan acts to cut the tarry deposit away from the sealing surfaces.

When the nozzle arrives at one of the four corners of the door, the carriage 20 is guided around the corner by the flanged frame members 43 and 44. The rotatable mounting of the stem member 27 in the body portion 23 permits the carriage to twist through a right angle as it is carried around the corner whilst the stem member 27 and the nozzle 29 do not rotate relative to the water hose, which does not rotate or twist about its axis. When the carriage has moved through the right angle, the second flat fan-shaped jet is perpendicular to the direction of travel of the nozzle 29. A similar change occurs at each corner on the frame 10, so that the carriage 20 can run continuously around the frame 10 with efficient cleaning of the sealing surfaces of a door or door jamb. The carriage 20 with its rotatable mounting for the stem member and the nozzle provides an extremely simple arrangement which avoids complex couplings with the hose supplying water to the nozzle.

We claim:

1. A machine for cleaning the sealing surfaces of an oven door or door jamb, said machine including a frame, a driveable conveying means held in said frame and having a carrier mounted thereto, means for driving the carrier continuously on a closed path adjacent and parallel to the sealing surfaces of the door or jamb, and water nozzle means rotatably mounted in or on the carrier for rotation about its axis relative to said carrier, such that as the carrier moves on its closed path the nozzle means may direct a jet of water towards the sealing surfaces of the door or jamb without rotating about its own axis.

2. A machine according to claim 1 including flow control means associated with the nozzle for enabling the nozzle to direct at least two flat fan-shaped jets towards the sealing surfaces of the door or jamb.

3. A machine according to claim 2 in which said flow control means directs the fan-shaped jets so they have a common axis.

4. A machine according to claim 3 in which the jets are equi-angularly spaced.

5. A machine according to claim 4 in which said sealing surfaces include parallel side edges and parallel top and bottom edges extending vertically between said side edges, and said jets are aligned respectively perpendicular to the side edges, and perpendicular to the top and bottom edges.

6. A machine according to claim 1 in which the conveying means includes a chain mechanism.

7. A machine according to claim 6 in which the chain mechanism includes a two parallel chains to which the carrier is attached.

8. A machine according to claim 1 in which the frame includes guide means for guiding the carrier around its closed path.

9. A machine according to claim 1 in which the conveying means is driven by a variable speed motor.

10. A machine according to claim 1 incorporating a high pressure water pump and hose arrangement adapted to supply water at between 1000 and 10000 p.s.i. to the water nozzle means.

11. A machine according to claim 1 in which said nozzle is adjustably mounted on said carrier for movement along its axis with respect to the carrier.

12. A machine for cleaning the sealing surfaces of an oven door or door jamb, said machine including a frame, a driveable conveying means held in said frame and having a carrier mounted thereto, means for driving the carrier continuously on a closed path adjacent and parallel to the sealing surfaces of the door or jamb, the carrier rotating with respect to the door as it traverses the closed path, water nozzle means rotatably mounted in or on the carrier for rotation about the nozzle axis, means for preventing the nozzle from rotating about the axis while the carrier moves on its closed path, and the nozzle means being arranged to direct a jet of water towards the sealing surfaces of the door or jamb.

* * * * *